US005615731A

United States Patent [19]

Roehrig et al.

[11] Patent Number: 5,615,731

[45] Date of Patent: Apr. 1, 1997

[54] CONTINOUS CASTING MOULD FOR AN I-SHAPED PRELIMINARY SECTION

[75] Inventors: Adalbert Roehrig, Thalwil; Franciszek Kawa, Adliswil, both of Switzerland

[73] Assignee: Concast Standard AG, Zurich, Switzerland

[21] Appl. No.: 504,597

[22] Filed: Jul. 20, 1995

[30] Foreign Application Priority Data

Jul. 25, 1994 [CH] Switzerland ..... 02337/94
Feb. 3, 1995 [CH] Switzerland ..... 00305/95

[51] Int. Cl.[6] ..... B22D 11/00

[52] U.S. Cl. ..... 164/418; 164/459

[58] Field of Search ..... 164/418, 459

[56] References Cited

U.S. PATENT DOCUMENTS

| | | | |
|---|---|---|---|
| 3,416,222 | 12/1968 | Pearson | 164/418 |
| 3,910,342 | 10/1975 | Johnson | 164/418 |
| 4,207,941 | 6/1980 | Shrum | 164/418 |
| 4,565,236 | 1/1986 | Masui et al. | 164/418 |
| 4,805,685 | 2/1989 | Lorento | 164/418 |
| 5,360,053 | 11/1994 | Kawa et al. | 164/418 |

FOREIGN PATENT DOCUMENTS

| | | |
|---|---|---|
| 531090 | 10/1956 | Canada . |
| 631400 | 2/1994 | Japan . |
| 729490 | 10/1952 | United Kingdom . |

*Primary Examiner*—Joseph J. Hail, III
*Assistant Examiner*—Randolph Herrick
*Attorney, Agent, or Firm*—Darby & Darby

[57] ABSTRACT

In the case of a continuous casting mould for a double T-shaped preliminary section comprising a mould cavity cross-section which is composed of two flange parts (4, 4') and a web part (5) firstly sticking of the billet in the mould is to be prevented and secondly simplified mould production is to be indicated. Furthermore it should be possible to produce sections of this type in tubular moulds, with high casting speed and high billet quality such that their dimensions are as close as possible to the final dimensions. To this end it is proposed that the mould cavity (3) be provided at the mould end on the pouring-in side, on both sides along the web (5) in each case with a cross-sectional enlargement, in the form of bulges (8), with respect to the identical mould cavity portion (7) at the mould end on the billet outlet side. A curve height (H) of the web bulge (8) should decrease between the end on the pouring-in side and the end on the billet outlet side in such a way that a geometric extension of an associated chord (9), which extension results from this decrease, completely or partially compensates the amount of shrinkage of the billet shell transversely to the longitudinal axis of the billet.

13 Claims, 2 Drawing Sheets

CONTINOUS CASTING MOULD FOR AN I-SHAPED PRELIMINARY SECTION

BACKGROUND OF THE INVENTION

The invention relates to a continuous casting mould for an I-shaped preliminary section.

The continuous casing of preliminary sections for producing profile steel, in particular I-shaped girders, has been known since 1968. Worldwide, only a few steelworks have hitherto produced such preliminary girder sections on a large scale since their production requires considerable know-how. The general trend towards casting sections to nearly final dimensions has increased interest in casting preliminary sections. In spite of this trend, the difficulties associated with the casting of such cross-sections have not yet been satisfactorily overcome. The main problem today is still the sticking of the billet in the mould, in particular when casting parameters do not correspond to the predetermined tape of the mould. Furthermore the expenditure involved in producing molds is very high.

German Auslegeschriift 1 282 861 discloses an ingot mould for the continuous casting of I-shaped sections. In accordance with the shrinkage of an I-shaped section the mould cavity has positive taper on the flange outer sides and negative taper on the flange inner sides. In order to improve machining of the mould cavity, the mould is constructed in two parts along a plane parallel to the web of the I-shaped section.

In order to cool the billet skin to a sufficient degree and to prevent the billet from sticking in the mould, the positive and negative mould tapers have to be adapted to the steel grade, the casting temperature, the casting speed, etc. If the billit sticks in the mould when a breakdown occurs, it can be removed from the two-part mould by opening the latter. However, such ingot moulds are expensive to manufacture. In addition, with moulds of this type different casting speeds easily lead to breakdowns and increased wear.

U.S. Pat. No. 4,805,685 further discloses a mould for casting I-shaped sections. In the case of this mould recesses in the mould cavity cross-section for the web part are shaped according to predetermined ratios. Transitional areas between the web part and the flange parts are defined precisely by a flat angle of inclination. These gentle transitions simplify the production of the mould cavity by dipensing with undercuts and negative mould cavity taper. However the teachings of this patent are remote from the casting of parts to nearly final dimensions and necessitate corresponding extensive rollowing and shaping.

SUMMARY OF THE INVENTION

The invention is based on the object of providing I-shaped mould which eliminates the aforementioned disadvantages and in particular avoids sticking of the billet in the mould. A further object resides in casting a preliminary girder section which has dimensions close to its final dimensions and which requires a minimum of reduction stages. An I-shaped preliminary section of this type is also to be cast with varying casting parameters, such as casting speed, casting temperature, etc. and simultaneously the quality both of the surface and of the structure are to be improved. Furthermore it should be possible to manufacture the mould simply as a tubular or ingot mould.

In accordance with the invention this object is the achieved by an I-shaped mould having a web portion provided with bulges. The heights of the bulges decrease in the direction of billet travel so as to at least partially compensate for shrinkage of the billet.

With the mould according to the invention it is possible for the first time to case I-shaped preliminary sections with dimensions close to their final dimensions using a mould without negative taper or undercuts. Such moulds can furthermore not only be produced as ingot or plate moulds, they can also be prepared is substantially more economical tubular moulds using relatively simple tools. Furthermore, by employing deliberate billet deformation within the mould, both the casting output and the billet quality, in particular the billet structure, can be improved. If, in the event of a breakdown, a billet should become stuck in the mould, it can be removed upwards since there are no undercuts in the mould. Owing to the shaping of the bulges as a function of the path of the billet through the mould, the casting parameters, in particular casting speed, can be varied without disturbances such as fractures, jamming, etc.

In accordance with one embodiment the shape of the bulges can be selected such that the shrinkage of the billet transversely to the direction in which the billet travels can be completely compensated for. Thus no tensile forces are directed towards the centre of the billet in either flange part. With respect to taper, each flange part can for the first time be regarded as separate from the web part and the associated mould cavity shaped accordingly. This freedom enables the five peripheral surfaces of these flange pars to taper inward in the direction of travel of the billet to a degree calculated on the basis of the flange dimensions.

As an alternative to the conventional taper, bulges can be provided at the peripheral surfaces of the flanges, and the bulges can decrease in size in the direction of travel of the billet at least along part of the length of the mould cavity in such a way that the billet is deformed on passing through the mould.

In accordance with a further embodiment the shape of the bulges in the web part can be selected such that the shrinkage of the billet shell is only partially compensated for. Thus tensile forces directed towards the centre are deliberately introduced into both flange parts. These tensile forces pull the portions of the flange parts which adjoin billet shell of the web part towards the centre of the billet. This allows the portions of the mould wall which correspond to the flange parts and adjoin the web part to be substantially parallel to the direction of travel of the billet. This can be particularly advantageous in tubular moulds which are shaped by a mandrel.

For reasons of billet quality or in order to attain increased casting output, deformation of the billet in other portions of the mould cavity may be desirable. In accordance with another embodiment portions of the mold corresponding to the flange parts are provided with cross-sectional enlargements, or bulges in an upstream part of the mould. The heights H of the bulges decrease in the direction of travel of the billet in such a way that, during the casting operation, a billet which forms in the mould is deformed as it passes through the latter. As a result of this measure optimum contact and thus a substantially increased cooling effect can be attained.

If the webs are long, the web bulges may extend only over a fraction of the distance between the flanges. However, in accordance with an additional embodiment the web bulges extend over the entire distance to the grooves of the flange connections.

The bulges can be delimited by broken, straight lines. In accordance with a further embodiment the bulges are delimited by curved lines, preferably circular lines.

The bulges on the web and/or on the two flanges can be completely eliminated for example shortly before the mould outlet, or the billet can still comprise a residual bulge when it leaves the mould. This makes it possible to effect billet deformation at the tip of the core or subsequently in the centre of the web.

The thickness of the web and of the two flanges is such that an optimum structure is attained when the I-shaped grider has been rolled. Furthermore it is preferred for the preliminary section to be close to its final dimensions and for the billet to be guided with as little support as possible. These considerations should be taken into account when the dimensions are selected. In accordance with a further embodiment the ratio of web thickness to flange thickness, each measured at its thinnest point, is approximately 1:1.

The height H of the bulge can decrease constantly or degressively, etc. over the entire length of the mould. In accordance with a further embodiment the height H only decreases over part of the mould length. Either a residual bulge or a straight mould wall with a conventional casting taper can be disposed at the downstream end of the mould.

BRIEF DESCRIPTION OF THE DRAWINGS

In the following the invention will be further explained with reference to examples. In the drawings.

DESCRIPTION OF THE PREFERRED EMBODIMENTS

Figure 1:
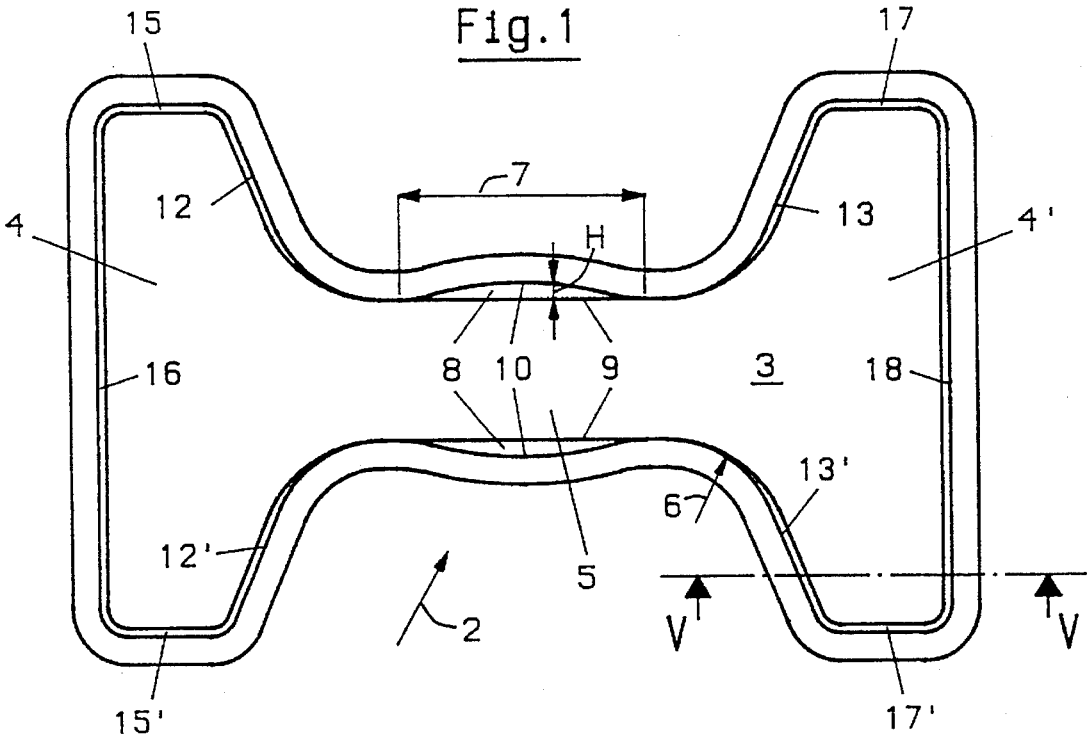
FIG. 1 shows a plan view of a tubular mould for an I-shaped preliminary girder section.

FIG. 1 shows a tubular mould designated 2 and having a mould cavity 3. The mould cavity cross-section is composed of two flange parts 4, 4' and a web part 5. A transitional radius 6 connects these cross-sectional parts. At the inlet end of the mould, a mould cavity cross-sectional enlargement, in the form of a web bulge 8, is provided on either side of the web part 5. In this example, the web bulge 8 is reduced to zero, i.e. the web part 5 is delimited by straight lines 9, at the outlet end of the mould. The lines 9 represent chords for the curved lines 10. The curve height H decreases steadily between the inlet end and the outlet end, and the chord associated with the curve is geometrically extended. At the beginning of solidification, a billet forming along the web part 5 has a bulge which is deformed into a flat surface during movement through the mould. If the billet were not subject to shrinkage transversely to the direction of movement, it would be the same length as the curved line 10 at the mould outlet. The decrease in the curve height H is such that a resultant geometric extension of the chord completely or partially compensates for the shrinkage of the web of the billet transversely to the direction of travel of the billet. In the example according to FIG. 1 the extension of the chord compensates for the shrinkage of the web completely. Thus no tensile forces are directed towards the centre of the billet in either flange part 4, 4'. The mould cavities of the two flange parts 4, 4' are respectively bounded by the five surfaces 12, 12',15, 15', 16 and 13, 13', 17, 17', 18 which taper inward in the direction of travel of the billet. In this example the taper can be adapted to the flange dimensions.

Figure 2:
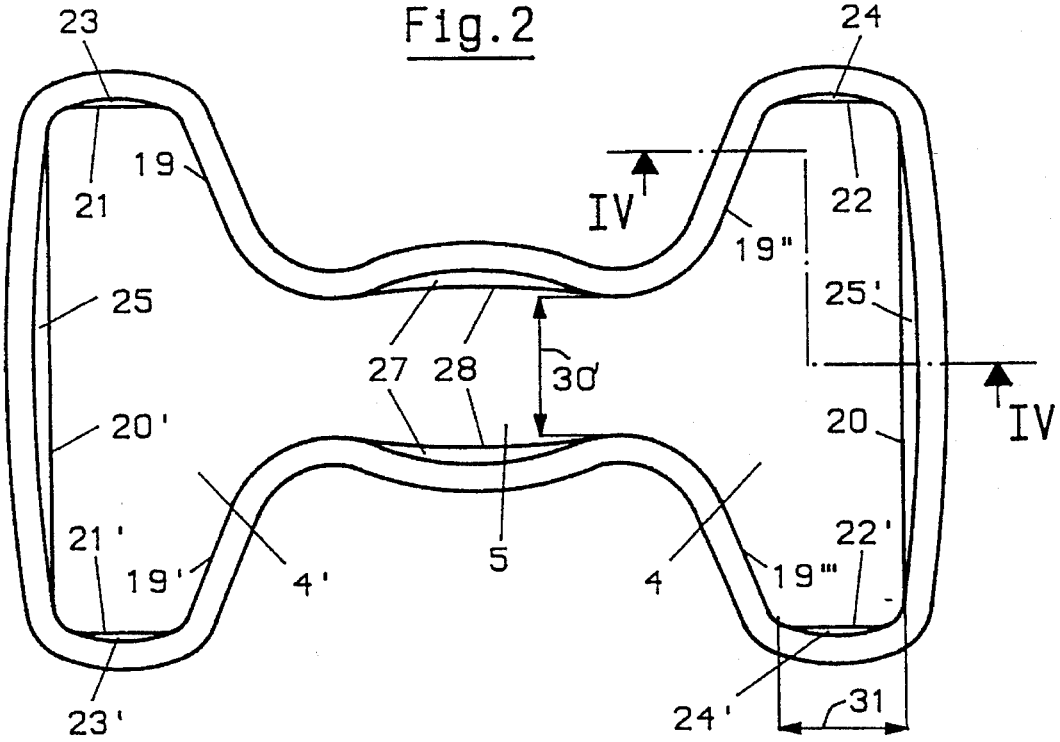
FIG. 2 shows a plan view of a further embodiment of a tubular mould.

In FIG. 2 the web part 5 has bulges 27. The decrease in the direction of travel of the billet to bulges 28 at the mould outlet, i.e. the cast billet emerging from the mould has a web part with a small residual bulge of 1–3 mm for example, which can be flattened for example during final solidification in the billet guide. Cross-sectional enlargements in the form of bulges 23, 23', 24, 24', 25, 25' are provided on the surfaces 20, 20', 21, 21', 22, 22' of the flange parts 4, 4'. All of these mould cavity bulges decrease in the direction of travel of the billet, and at the mould outlet end the curve heights of the bulges 23, 24, 25 are zero. These bulges 23, 24, 25 improve control of solidification in the flange parts 4, 4' and make higher casting speeds possible.

In the example according to FIG. 2, when the bulge 27 is shaped back, the web part 5 is provided with a chord extension which only partially compensates the shrinkage of the web of the billet transversely to the direction of travel of the billet is only partially compensated for. Part of the shrinkage is utilized in shaping the mould wall parts of the flange wall inner sides 19, 19', 19", 19'" which adjoin the web 5 and which run substantially parallel to the direction of travel of the billet. i.e. do not have any casting taper. Not only are the tools for producing the mould substantially simpler owing to this shaping but the deformation of a copper tube blank to produce an I-shaped mould of this type is also substantially easier.

Figure 3:
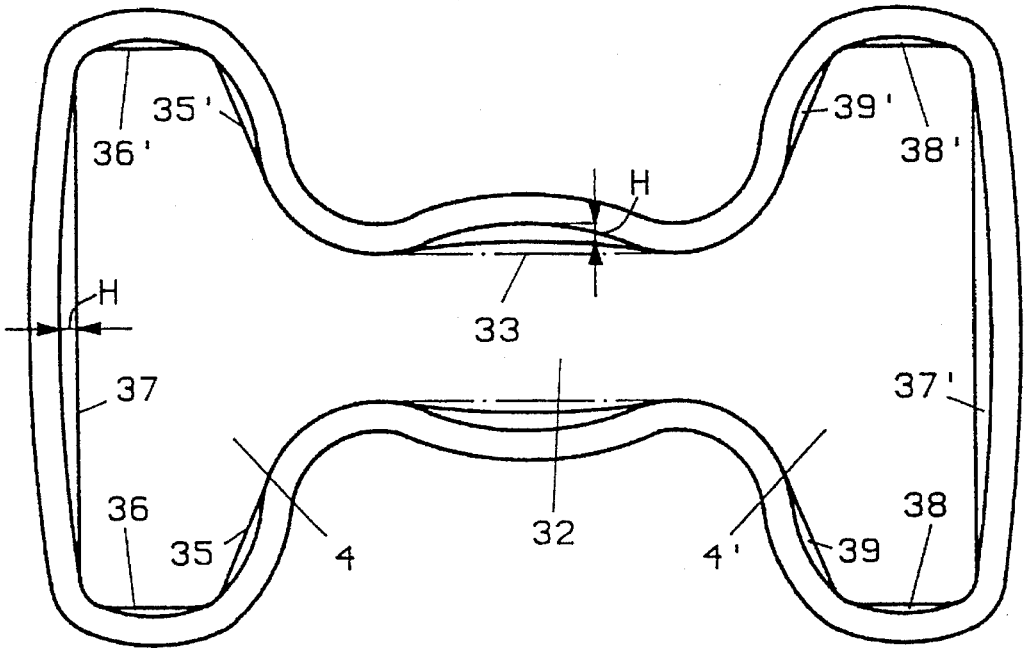
FIG. 3 shows a plan view of a further embodiment of a tubular mould.

In FIG. 3, the web part 32 is provided with an extension of the chord 33, which extension completely compensates for the shrinkage of the web of the billet transversely to the direction of travel of the billet. No tensile forces directed towards the centre of the billet are produced in either of the two flange parts 4, 4'. Instead of the taper provided in FIG. 1 at the delimiting surfaces 12, 13, 15, 16, 17, 18 of the flange parts 4, 4', in this example mould cavity cross-sectional enlargements, in the form of bulges, are here provided on all the delimiting surfaces 35–39 at the mould inlet end. The curve heights H of the bulges decrease at least along part of the mould cavity length in such a way that, during the casting operation, a billet which forms in the mould cavity is deformed on passing through the latter.

The bulges provided in FIG. 3 improve control solidification in the flange parts and make possible higher casting speeds and/or a reduction in or omission of billet supports below the mould, in particular when the cross-sections are close to final dimensions or the preliminary sections are small.

Figure 4:
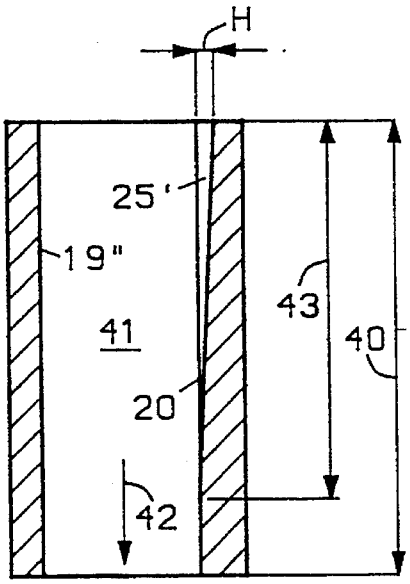
FIG. 4 shows a section along the line IV—IV of FIG. 2.

FIG. 4 shows the flange part 4 of FIG. 2 in section. The dimension 40 represents the length of the mould cavity 41. The flange wall inner side 19" does not taper in the casting direction 42 and the flange delimiting surface 20 is provided over part of its height 43 with a bulge 25' which has a curve height H at the inlet end. At the end of the segment 43 H=0.

Figure 5:
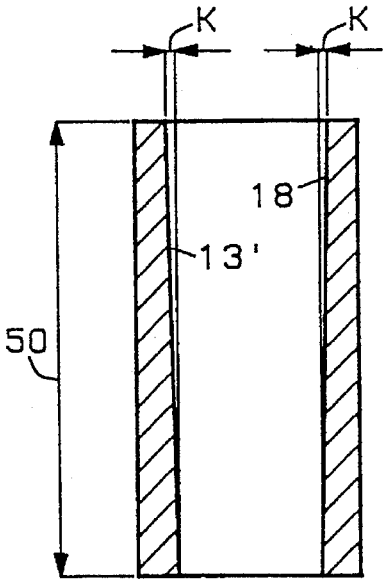
FIG. 5 shows a section along the line V—V of FIG. 1.

FIG. 5 shows the flange part 4' of FIG. 1 in section. The length of the mould is designated 50 and the taper of the mould cavity id designated K.

In the examples shown the billet bulges extend over the entire length of the web to the transitional radius 6 of the flange connections.

All the bulges are delimited by curved lines, preferably circular lines.

The ratio of the web thickness 30 to the flange thickness 31 of the preliminary section is approximately 1"1, measured at its thinnest points.

The invention can not only be applied to symmetrical I-shaped preliminary sections for asymmetric I-shaped preliminary sections, as are used for railway tracks, for example, etc.

We claim:

1. A continuous casting mold, comprising a first wall section having first lateral ends; a second wall section facing and spaced from said first wall section and having second lateral ends; a third wall section joining one of said first ends to one of said second ends; and a fourth wall section joining the other of said first ends to the other of said second ends, said wall sections cooperating to define a generally I-shaped casting passage having a web part between said first and second wall sections and two flange parts respectively delimited by said third and fourth wall sections, said casting passage further having an inlet end for molten metal and an outlet end for a continuously cast strand formed from the molten metal, and said first wall section being provided with a first outward bulge in said web part while said second wall section is provided with a second outward bulge in said web part, said bulges extending between respective first locations nearer said inlet end and respective second locations more remote from said inlet end, and said bulges having heights, as considered transversely of said passage, which decrease in a direction from said first locations to said second locations so as to at least partially compensate for shrinkage in said web part of a strand transversely of said passage to prevent jamming of the two flange parts by shrinkage of the strand shell of the web part.

2. The mold of claim 1, wherein said passage has a center and said heights decrease such that, during travel of a strand through said passage, said flange parts are substantially free of tensile forces directed transversely of said passage towards said center.

3. The mold of claim 1, wherein each of said third and fourth wall sections has a plurality of surface portions which face said passage, each of said surface portions tapering inward in said direction to a degree related to the dimensions of the respective flange part.

4. The mold of claim 1, wherein said heights decrease such that a strand undergoes deformation during travel through said passage.

5. The mold of claim 1, wherein said passage has a longitudinal axis and said heights decrease so as to only partially compensate for shrinkage of a strand transversely of said passage, said third and fourth wall sections having surface portions adjacent said first and second wall sections, and said surface portions being substantially parallel to said axis.

6. The mold of claim 1, wherein each of said third and fourth wall sections is provided with an additional outward bulge extending between a respective predetermined location nearer said inlet end and a respective additional location more remote from said inlet end, said additional bulges having heights, as considered transversely of said passage, which decrease in said direction such that a strand undergoes deformation during travel through said passage.

7. The mold of claim 1, wherein said first bulge extends essentially from one of said first ends to the other and said second bulge extends essentially from one of said second ends to the other.

8. The mold of claim 1, wherein said heights decrease substantially continuously and are substantially zero at said second locations.

9. The mold of claim 1, wherein said web part has a first minimum thickness and one of said flange parts has a second minimum thickness, the ratio of said first thickness to said second thickness being approximately 1:1.

10. The mold of claim 1, wherein said passage has an outline resembling a railroad track and said flange parts have different cross-sectional areas.

11. The mold of claim 1, wherein said heights are greater than zero at said outlet end.

12. The mold of claim 1, wherein said bulges are curved.

13. The mold of claim 12, wherein said bulges extend along substantially circular arcs.

* * * * *